US008684691B2

(12) United States Patent
Lee et al.

(10) Patent No.: US 8,684,691 B2
(45) Date of Patent: Apr. 1, 2014

(54) TURBINE BLADE WITH CHAMFERED SQUEALER TIP AND CONVECTIVE COOLING HOLES

(75) Inventors: Ching-Pang Lee, Cincinnati, OH (US); Shantanu P. Mhetras, Orlando, FL (US); Glenn E. Brown, West Palm Beach, FL (US)

(73) Assignee: Siemens Energy, Inc., Orlando, FL (US)

( * ) Notice: Subject to any disclaimer, the term of this patent is extended or adjusted under 35 U.S.C. 154(b) by 406 days.

(21) Appl. No.: 13/099,521

(22) Filed: May 3, 2011

(65) Prior Publication Data

US 2012/0282108 A1 Nov. 8, 2012

(51) Int. Cl.
*F01D 5/20* (2006.01)

(52) U.S. Cl.
USPC ..... 416/92; 416/224

(58) Field of Classification Search
CPC ..... F01D 5/20; F01D 11/08
USPC ..... 416/224, 92, 90 R, 228
See application file for complete search history.

(56) References Cited

U.S. PATENT DOCUMENTS

| | | | | |
|---|---|---|---|---|
| 4,893,987 | A | 1/1990 | Lee et al. | |
| 5,096,379 | A | 3/1992 | Stroud et al. | |
| 5,183,385 | A | 2/1993 | Lee et al. | |
| 5,348,446 | A | 9/1994 | Lee et al. | |
| 6,224,336 | B1 | 5/2001 | Kercher | |
| 6,224,337 | B1 * | 5/2001 | Lieland et al. | 416/97 R |
| 6,243,948 | B1 | 6/2001 | Lee et al. | |
| 6,267,552 | B1 | 7/2001 | Weigand | |
| 6,287,075 | B1 | 9/2001 | Kercher | |
| 6,514,037 | B1 | 2/2003 | Danowski | |
| 6,667,076 | B2 | 12/2003 | Fried et al. | |
| 6,923,247 | B1 | 8/2005 | Ferber et al. | |
| 7,186,085 | B2 | 3/2007 | Lee | |
| 7,249,934 | B2 | 7/2007 | Palmer et al. | |
| 7,568,887 | B1 | 8/2009 | Liang | |
| 7,645,123 | B1 * | 1/2010 | Liang | 416/241 R |
| 2002/0187044 | A1 | 12/2002 | Lee et al. | |
| 2002/0197160 | A1 * | 12/2002 | Liang | 416/92 |
| 2003/0223870 | A1 | 12/2003 | Keith et al. | |
| 2008/0060197 | A1 | 3/2008 | Lee | |
| 2008/0095622 | A1 | 4/2008 | Naik | |
| 2009/0183657 | A1 | 7/2009 | Fischer | |
| 2009/0297361 | A1 | 12/2009 | Dahmer et al. | |
| 2010/0068032 | A1 | 3/2010 | Liang | |
| 2010/0115967 | A1 | 5/2010 | Maltson | |
| 2010/0135822 | A1 * | 6/2010 | Marini et al. | 416/97 R |

* cited by examiner

*Primary Examiner* — Richard Edgar

(57) ABSTRACT

A squealer tip formed from a pressure side rib and a suction side rib extending radially outward from a tip of the turbine blade is disclosed. The pressure and suction side ribs may be positioned along the pressure side and the suction side of the turbine blade, respectively. The pressure and suction side ribs may include chamfered leading edges with film cooling holes having exhaust outlets positioned therein. The film cooling holes may be configured to be diffusion cooling holes with one or more tapered sections for reducing the velocity of cooling fluids and increasing the size of the convective surfaces.

20 Claims, 3 Drawing Sheets

TURBINE BLADE WITH CHAMFERED SQUEALER TIP AND CONVECTIVE COOLING HOLES

FIELD OF THE INVENTION

This invention is directed generally to turbine blades, and more particularly to airfoil tips for turbine blades.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine blade assemblies to these high temperatures. As a result, turbine blades must be made of materials capable of withstanding such high temperatures.

Typically, turbine blade is formed from a root portion at one end and an elongated portion forming a blade that extends outwardly from a platform coupled to the root portion at an opposite end of the turbine blade. The blade is ordinarily composed of a tip opposite the root section, a leading edge, and a trailing edge. The tip of a turbine blade often has a tip feature to reduce the size of the gap between ring segments and blades in the gas path of the turbine to prevent tip flow leakage, which reduces the amount of torque generated by the turbine blades. The tip features are often referred to as squealer tips and are frequently incorporated onto the tips of blades to help reduce pressure losses between turbine stages. These features are designed to minimize the leakage between the blade tip and the ring segment.

SUMMARY OF THE INVENTION

A squealer tip formed from a pressure side rib and a suction side rib extending radially outward from a tip of a turbine blade is disclosed. The pressure and suction side ribs may be positioned along a pressure side and a suction side of the turbine blade, respectively. The pressure and suction side ribs may include chamfered leading edges with film cooling holes having exhaust outlets positioned therein. The film cooling holes may be configured to be diffusion cooling holes with one or more tapered sections for reducing the velocity of cooling fluids.

The turbine blade may be formed from a generally elongated blade having a leading edge, a trailing edge, a tip at a first end, a root coupled to the blade at a second end generally opposite the first end for supporting the blade and for coupling the blade to a disc, and an internal cooling system formed from at least one cavity positioned within the generally elongated blade. The turbine blade may include one or more pressure side ribs extending radially from an outer surface forming the tip. The pressure side rib may include a chamfered surface positioned at an acute angle relative to an outer surface of the generally elongated blade forming a pressure side surface. The pressure side rib may extend from the leading edge and terminate at the trailing edge. The pressure side rib may have an outer side surface that is aligned with the outer surface of the generally elongated blade forming the pressure side. The chamfered surface of the pressure side rib may only extend for only a portion of an entire length of the pressure side rib.

One or more film cooling holes may be positioned in the pressure side rib with an outlet in an outer surface in the pressure side rib and an inlet that couples the film cooling hole with the cavity forming the internal cooling system. The outlet of the film cooling hole may be positioned in the chamfered surface of the pressure side rib. The film cooling hole may be formed from a compound diffuser film cooling hole having at least one tapered section with an increasing cross-sectional area.

The turbine blade may also include one or more suction side ribs extending radially from an outer surface for the tip. The suction side rib may include a chamfered surface positioned at an acute angle relative to an outer surface of the tip of the generally elongated blade. The chamfered surface of the suction side rib may be positioned on an interior surface of the suction side rib. The suction side rib may have an outer side surface that is aligned with an outer surface of the generally elongated blade forming a suction side. The suction side rib may extend from the trailing edge toward the leading edge of the generally elongated blade and terminate at the leading edge and may be coupled to the pressure side rib. The chamfered surface of the suction side rib may only extend for a portion of an entire length of the suction side rib, such as in a mid-chord region.

The turbine blade may also include one or more film cooling holes positioned in the suction side rib with an outlet in an outer surface in the suction side rib and an inlet that couples the film cooling hole with the cavity forming the internal cooling system. The outlet of the film cooling hole may be positioned in the chamfered surface of the suction side rib. The film cooling hole may be formed from a compound diffuser film cooling hole having one or more tapered sections having an increasing cross-sectional area moving downstream.

A thermal barrier coating may be included on the outer surfaces forming the pressure and suction sides, on the chamfered surfaces of the pressure and suction side ribs, on the outer surface of the tip and on an inner surface of the pressure side rib. The thermal barrier coating may protect the turbine blade from hot gases in the hot gas path of the turbine engine.

An advantage of this invention is that the tapered section of the compound angle diffuser film cooling hole increases the convection cooling surface and cooling coverage inside the squealer tip.

Another advantage of this invention is that the squealer tip has a low tip leakage flow and reliable convective cooling to the squealer tip.

Yet another advantage of this invention is that the chamfered surface enables cooling holes to be positioned on the surface at hot spots and for the cooling holes to have longer lengths for better cooling.

Another advantage of this invention is that the cooling holes also provide exit film cooling at the chamfered surface, thereby reducing the temperature of the airfoil at a location that is typically a hot spot, which is an area of material having an increased temperature.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
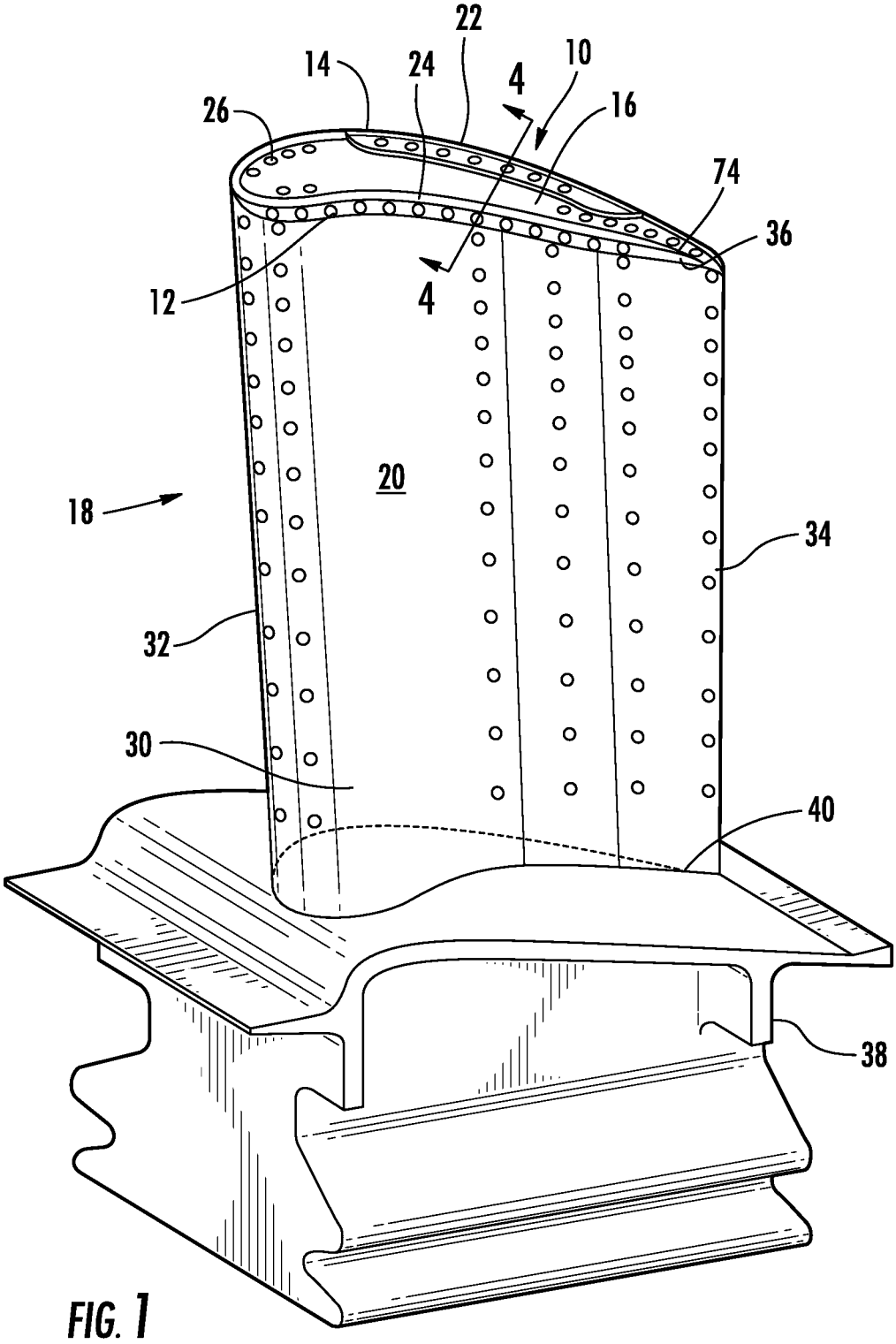
FIG. 1 is a perspective view of a turbine blade with a squealer tip.
Figure 2:
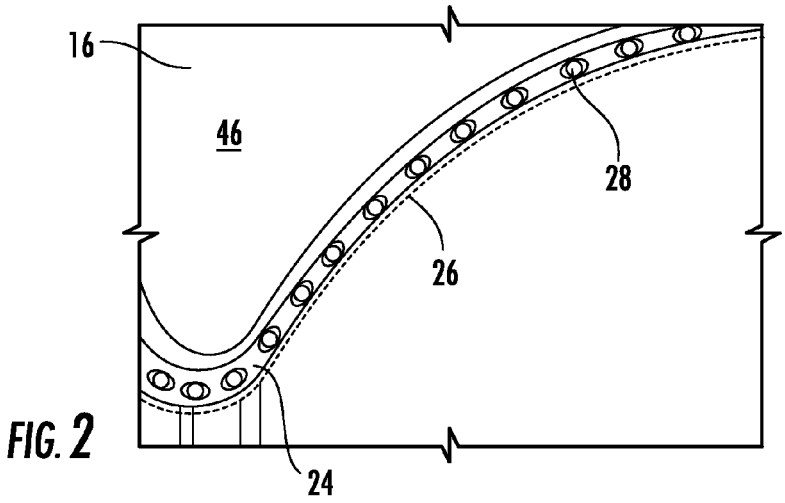
FIG. 2 is a detailed view of the squealer tip at the leading edge of the turbine blade shown in FIG. 1.

As shown in FIGS. 1-7, a squealer tip 10 formed from a pressure side rib 12 and a suction side rib 14 extending radially outward from a tip 16 of a turbine blade 18 is disclosed. The pressure and suction side ribs 12, 14 may be positioned along a pressure side 20 and a suction side 22 of the turbine blade 18, respectively. The pressure and suction side ribs 12, 14 may include chamfered leading edges 24 with film cooling holes 26 having exhaust outlets 28 positioned therein. The film cooling holes 26 may be configured to be diffusion cooling holes with one or more tapered sections 28 for reducing the velocity of cooling fluids, increasing the convective surfaces, thereby increasing the efficiency of the cooling system.

The turbine blade 18 may be formed from a generally elongated blade 30 having a leading edge 32 and a trailing edge 34. The generally elongated blade 30 may include a tip 16 at a first end 36 and a root 38 coupled to the blade 30 at a second end 40 generally opposite the first end 36 for supporting the blade 18 and for coupling the blade 18 to a disc. An internal cooling system 42 may be formed from at least one cavity 44 positioned within the generally elongated blade 30. The cooling system 42 may have any appropriate configuration to cool the turbine blade 18 during use in an operating gas turbine engine. The turbine blade 18 and its related components listed above may be formed from any appropriate material already known in the art or yet to be discovered or identified.

Figure 3:
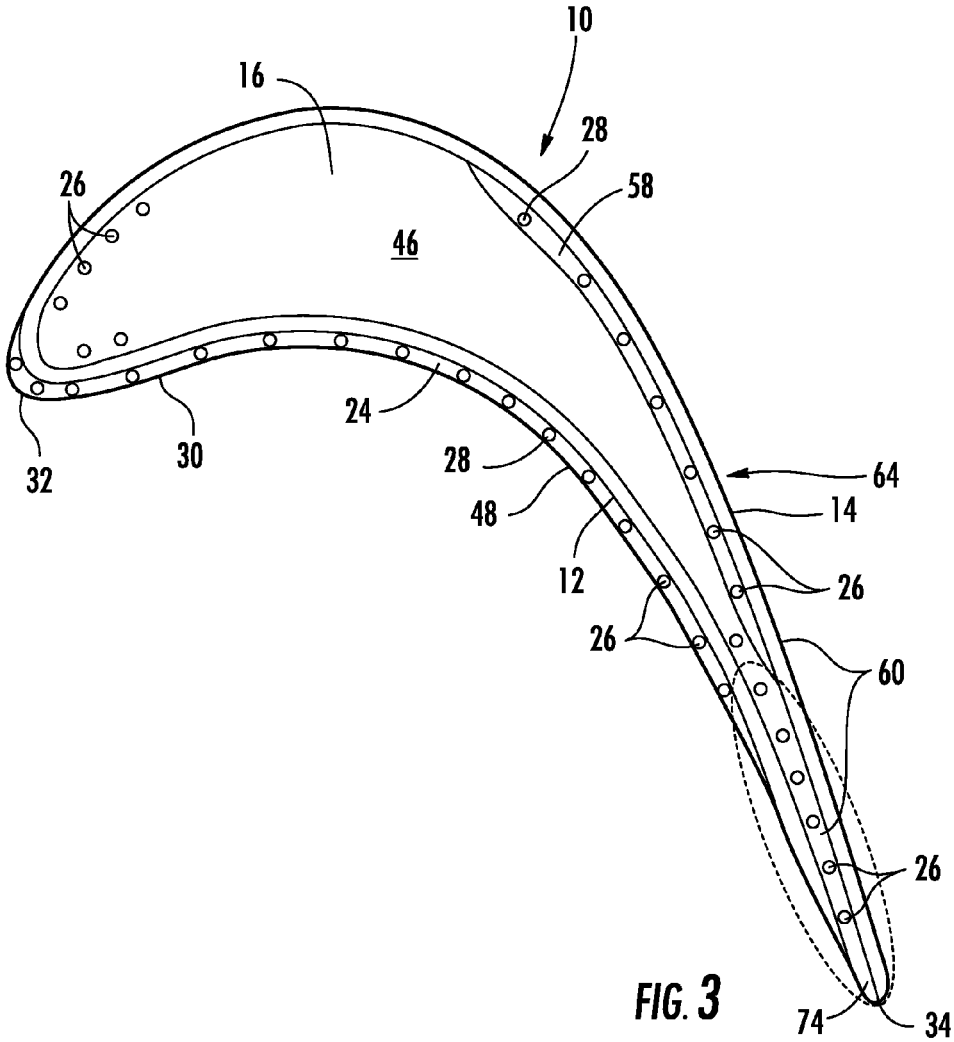
FIG. 3 is top view of the squealer tip shown in FIG. 1.
Figure 4:
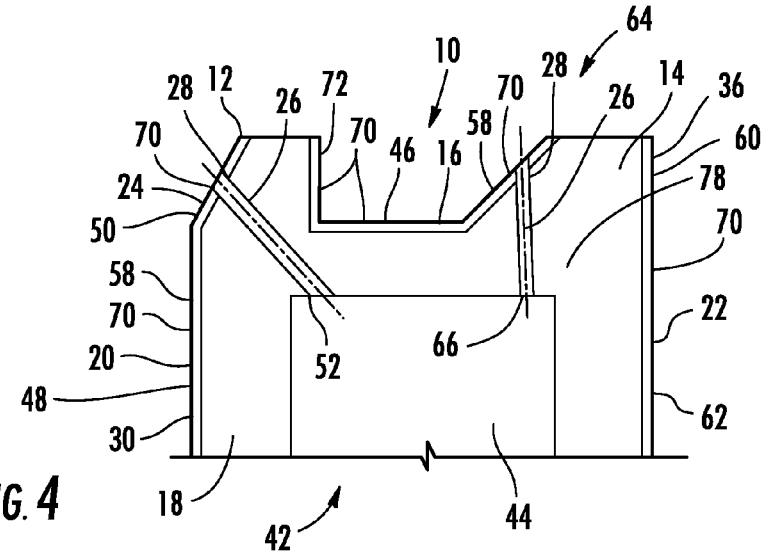
FIG. 4 is a partial cross-sectional view of the turbine blade tip taken at section line 4-4 in FIG. 1.

The pressure side rib 12 may extend radially from an outer surface 46 of the tip 16. In one embodiment, the pressure side rib 12 may extend from the leading edge 32 and may terminate at the trailing edge 34, as shown in FIG. 3. The pressure side rib 12 may have an outer side surface 46 that is aligned with the outer surface 48 of the generally elongated blade 30 forming the pressure side 20. The pressure side rib 12 may have any appropriate height and width. In at least one embodiment, as shown in FIG. 4, the pressure side rib 12 may have a height to width ratio of between about 2:1 and 1:2, and in at least one embodiment, may be about 1:1.

The pressure side rib 12 may include a chamfered surface 24 positioned at an acute angle relative to an outer surface 48 of the generally elongated blade 30 forming the pressure side surface 20. In at least one embodiment, as shown in FIGS. 3 and 7, the chamfered surface 24 of the pressure side rib 12 may only extend for a portion of an entire length of the pressure side rib 12.

One or more film cooling holes 26 may be positioned in the pressure side rib 12 with an outlet 28 in an outer surface 50 in the pressure side rib 12 and an inlet 52 that couples the film cooling hole 26 with the cavity 44 forming the internal cooling system 42. In one embodiment, as shown in FIGS. 3 and 4, the outlet 28 of the film cooling hole 26 may be positioned in the chamfered surface 24 of the pressure side rib 12. The film cooling hole 26 in the pressure side rib 12 may be formed from a compound diffuser film cooling hole having at least one tapered section 56 with an increasing cross-sectional area.

The turbine blade 18 may also include one or more suction side ribs 14 extending radially from an outer surface 46 for the tip 16. The suction side rib 14 may extend from the trailing edge 34 to the leading edge 32 of the generally elongated blade 30 and terminate at the leading edge 32 and in communication with the pressure side rib 12. The suction side rib 14 may have an outer side surface 60 that is adjacent to an outer surface 62 of the generally elongated blade 30 forming the suction side 22. The suction side rib 14 may have any appropriate height and width. In at least one embodiment, as shown in FIG. 4, the suction side rib 14 may have a height to width ratio of between about 2:1 and 1:2, and in at least one embodiment, may be about 1:1.

Figure 7:
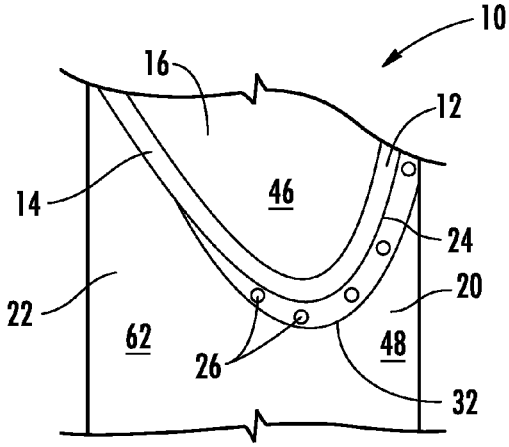
FIG. 7 is an alternative view of the leading edge of the squealer tip of the turbine blade.

As shown in FIGS. 3 and 7, the chamfered surface 24 of the pressure side rib 12 may extend from the pressure side 20 around the leading edge 32 and partially onto the suction side rib 14. As shown in FIG. 3, the suction side rib 14 may include a chamfered surface 58 positioned at an acute angle relative to an outer surface 46 of the tip 16 of the generally elongated blade 30. The chamfered surface 58 of the suction side rib 14 may only extend for a portion of an entire length of the suction side rib 14. For instance, as shown in FIG. 3, the chamfered surface 58 of the suction side rib 14 may only extend for a portion of the blade 18, such as within the mid chord region 88.

The suction side rib 14 may include a film cooling hole 26 positioned in the suction side rib 14 with an outlet 28 in an outer surface 64 in the suction side rib 14, and an inlet 66 that couples the film cooling hole 26 with the cavity 44 forming the internal cooling system 42. The outlet 28 of the film cooling hole 26 may be positioned in the chamfered surface 58 of the suction side rib 14. The film cooling hole 26 may be formed from a compound angle diffuser film cooling hole 80 having at least one tapered section 56 having an increasing cross-sectional area moving downstream.

As shown in FIG. 4, the turbine blade 18 may include a thermal barrier coating 70 on the outer surfaces 46 forming the pressure and suction sides 20, 22, on the chamfered surfaces 24, 58 of the pressure and suction side ribs 20, 22, on the outer surface 46 of the tip 16 and on an interior surface 72 of the pressure side rib. The thermal barrier coating 70 may be formed from any appropriate material for protecting the turbine blade 18 from the hot temperatures found in the hot gas path of the turbine engine.

As shown in FIG. 3, the turbine blade 18 may include a tip slot 74 defined by the pressure and suction side ribs 12, 14 and an outer surface 46 of the tip 16 at the trailing edge 34. The tip slot 74 may be machined from material forming the pressure and suction side tip ribs 12, 14.

The film cooling holes 26 positioned in the pressure side ribs 12 or the suction side ribs 14, or both, may be formed from one or more diffusion cooling holes. The diffusion cooling holes may be formed from a compound angle diffuser film cooling hole 80 having at least one tapered section 56 with an increasing cross-sectional area. The tapered section 56 may extend only partially through the outer wall 78 forming the tip 16 and may be coupled to a consistent section 82. The compound angle diffuser film cooling hole 80 may be used for increased cooling coverage. For instance, as shown in FIG. 4, the film cooling holes 26 positioned in the suction side rib 14 may extend radially outward through the suction side rib 14. The film cooling holes 26 positioned in the pressure side rib 12 may extend at an acute angle relative to the outer surface 48 of the pressure side 20. In addition, the film cooling hole 26 may extend into the pressure side rib 12 at an acute angle relative to the chamfered surface 24 of the pressure side rib 12. In another embodiment, the film cooling hole 26 may extend into the pressure side rib 12 generally orthogonal to the chamfered surface 24 of the pressure side rib 12.

Figure 5:
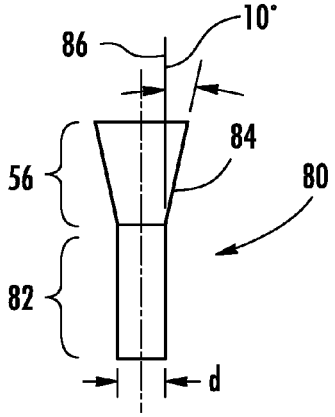
FIG. 5 is a detail front view of a compound angle diffuser film cooling hole positioned within the pressure and suction side ribs.
Figure 6:
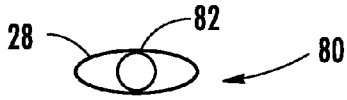
FIG. 6 is a detail top view of a compound angle diffuser film cooling hole positioned within the pressure and suction side ribs.

As shown in FIG. 6, tapered section 56 of the compound angle diffuser film cooling hole 80 may have a generally oval cross-sectional shape, and the consistent section 82 may have a generally consistent diameter. As shown in FIGS. 5 and 6, the tapered section 56 may be formed from an outer wall surface 84 positioned at between about five degrees and about 15 degrees from an extension line 86 extending from the wall surface forming the consistent section 82. In one embodiment, the tapered section 56 may be formed from an outer wall surface 84 positioned at about ten degrees from the extension line 86 extending from the wall surface forming the consistent section 82.

As shown in FIG. 3, the turbine blade 18 may also include one or more film cooling holes 26 positioned in the outer surface 46 of the tip 16 near the leading edge 32. The turbine blade may also include one or more film cooling holes 26 positioned in the outer surface 46 of the tip 16 near the trailing edge 34.

During use, cooling fluids are passed into the internal cooling system 42. The cooling fluids may be passed into the film cooling holes 26 in the tip 16 of the turbine blade 18. The cooling fluids may cooling the tip 16 through convection and may cool aspects of the squealer tip by being exhausted through the outlets 28. A portion of the cooling fluids may collect in the squealer tip downstream from the pressure side rib 12 and may be exhausted through the tip slot 74.

The foregoing is provided for purposes of illustrating, explaining, and describing embodiments of this invention. Modifications and adaptations to these embodiments will be apparent to those skilled in the art and may be made without departing from the scope or spirit of this invention.

We claim:

1. A turbine blade, comprising:

a generally elongated blade having a leading edge, a trailing edge, a tip at a first end, a root coupled to the blade at a second end generally opposite the first end for supporting the blade and for coupling the blade to a disc, and an internal cooling system formed from at least one cavity positioned within the generally elongated blade; and at least one pressure side rib extending radially from an outer surface of the tip, wherein the at least one pressure side rib includes a chamfered surface positioned at an acute angle relative to an outer surface of the generally elongated blade forming a pressure side;

at least one film cooling hole positioned in the at least one pressure side rib with an outlet in an outer surface in the at least one pressure side rib and an inlet that couples the at least one film cooling hole with the at least one cavity forming the internal cooling system wherein the outlet of the at least one film cooling hole is positioned in the chamfered surface of the at least one pressure side rib;

wherein the at least one film cooling hole in the chamfered surface of the at least one pressure side rib is formed from a compound diffuser film cooling hole having at least one tapered section with an increasing cross-sectional area;

at least one suction side rib extending radially from an outer surface of the tip, wherein the at least one suction side rib includes a chamfered surface positioned at an acute angle relative to an outer surface of the tip of the generally elongated blade;

at least one film cooling hole positioned in the at least one suction side rib with an outlet in an outer surface in the at least one suction side rib and an inlet that couples the at least one film cooling hole with the at least one cavity forming the internal cooling system;

wherein the at least one pressure side rib and the at least one suction side rib are separated by a linear tip surface in which a plurality of outlets of film cooling holes reside.

2. The turbine blade of claim 1, wherein the chamfered surface of the at least one pressure side rib only extends for a portion of an entire length of the at least one pressure side rib.

3. The turbine blade of claim 1, wherein the at least one pressure side rib extends from the leading edge and terminates at the trailing edge.

4. The turbine blade of claim 1, wherein the at least one pressure side rib has an outer side surface that is aligned with the outer surface of the generally elongated blade forming the pressure side.

5. The turbine blade of claim 1, wherein the chamfered surface of the at least one suction side rib extends for a portion of an entire length of the at least one suction side rib.

6. The turbine blade of claim 1, wherein the at least one suction side rib has an outer side surface that is aligned with an outer surface of the generally elongated blade forming a suction side.

7. The turbine blade of claim 6, wherein the at least one suction side rib extends from the trailing edge toward the leading edge of the generally elongated blade, terminates at the leading edge and is coupled to the at least one pressure side rib.

8. The turbine blade of claim 7, wherein the at least one pressure side rib and the at least one suction side rib are separated by a tip slot positioned at the trailing edge.

9. The turbine blade of claim 1, wherein the outlet of the at least one film cooling hole is positioned in the chamfered surface of the at least one suction side rib.

10. The turbine blade of claim 9, wherein the at least one film cooling hole is formed from a compound diffuser film cooling hole having at least one tapered section having an increasing cross-sectional area moving downstream.

11. The turbine blade of claim 1, further comprising a thermal barrier coating on the outer surfaces forming the pressure and suction sides, on chamfered surfaces of the pressure and suction side ribs, on the outer surface of the tip and on an interior surface of the at least one pressure side rib.

12. The turbine blade of claim 1, wherein the at least one pressure side rib has a height to width ratio of between 2:1 and 1:2.

13. The turbine blade of claim 1, wherein the at least one suction side rib has a height to width ratio of between 2:1 and 1:2.

14. A turbine blade, comprising:

a generally elongated blade having a leading edge, a trailing edge, a tip at a first end, and a root coupled to the blade at a second end generally opposite the first end for supporting the blade and for coupling the blade to a disc, an internal cooling system formed from at least one cavity positioned within the generally elongated blade; and at least one pressure side rib extending radially from an outer surface of the tip, wherein the at least one pressure side rib includes a chamfered surface positioned at an acute angle relative to an outer surface of the generally elongated blade forming a pressure side;

wherein the chamfered surface of the at least one pressure side rib extends for a portion of an entire length of the at least one pressure side rib;

wherein the at least one pressure side rib extends from the leading edge and terminates at the trailing edge;

wherein the at least one pressure side rib has an outer side surface that is aligned with the outer surface of the generally elongated blade forming the pressure side;

at least one suction side rib extending radially from an outer surface of the tip, wherein the at least one suction side rib includes a chamfered surface positioned at an acute angle relative to an outer surface of the tip of the generally elongated blade;

wherein the chamfered surface of the at least one suction side rib only extends for a portion of an entire length of the at least one suction side rib;

wherein the at least one suction side rib has an outer side surface that is aligned with an outer surface of the generally elongated blade forming a suction side;

wherein the at least one suction side rib extends from the trailing edge toward the leading edge of the generally elongated blade, terminates at the leading edge and is coupled to the pressure side rib;

wherein the at least one pressure side rib and the at least one suction side rib are separated by a linear tip surface;

wherein the at least one pressure side rib has a height to width ratio of between 2:1 and 1:2 and the at least one suction side rib has a height to width ratio of between 2:1 and 1:2.

15. The turbine blade of claim 14, further comprising at least one film cooling hole positioned in the at least one pressure side rib with an outlet in an outer surface in the at least one pressure side rib and an inlet that couples the at least one film cooling hole with the at least one cavity forming the internal cooling system.

16. The turbine blade of claim 15, wherein the outlet of the at least one film cooling hole is positioned in the chamfered surface of the at least one pressure side rib and wherein the at least one film cooling hole is formed from a compound diffuser film cooling hole having at least one tapered section with an increasing cross-sectional area.

17. The turbine blade of claim 14, further comprising at least one film cooling hole positioned in the at least one suction side rib with an outlet in an outer surface in the at least one suction side rib and an inlet that couples the at least one film cooling hole with the at least one cavity forming the internal cooling system, wherein the outlet of the at least one film cooling hole is positioned in the chamfered surface of the at least one suction side rib, and wherein the at least one film cooling hole is formed from a compound diffuser film cooling hole having at least one tapered section having an increasing cross-sectional area moving downstream.

18. The turbine blade of claim 14, wherein the at least one pressure side rib and the at least one suction side rib are separated by a tip slot positioned at the trailing edge.

19. A turbine blade, comprising:

a generally elongated blade having a leading edge, a trailing edge, a tip at a first end, a root coupled to the blade at a second end generally opposite the first end for supporting the blade and for coupling the blade to a disc, and an internal cooling system formed from at least one cavity positioned within the generally elongated blade; and at least one pressure side rib extending radially from an outer surface of the tip, wherein the at least one pressure side rib includes a chamfered surface positioned at an acute angle relative to an outer surface of the generally elongated blade forming a pressure side;

wherein the chamfered surface of the at least one pressure side rib extends for a portion of an entire length of the at least one pressure side rib;

wherein the at least one pressure side rib extends from the leading edge and terminates at the trailing edge;

wherein the at least one pressure side rib has an outer side surface that is aligned with the outer surface of the generally elongated blade forming the pressure side;

at least one suction side rib extending radially from an outer surface of the tip, wherein the at least one suction side rib includes a chamfered surface positioned at an acute angle relative to an outer surface of the tip of the generally elongated blade;

wherein the chamfered surface of the at least one suction side rib only extends for a portion of an entire length of the at least one suction side rib;

wherein the at least one suction side rib has an outer side surface that is aligned with an outer surface of the generally elongated blade forming a suction side;

wherein the at least one suction side rib extends from the trailing edge toward the leading edge of the generally elongated blade and terminates at the leading edge and is coupled to the pressure side rib;

at least one film cooling hole positioned in the at least one pressure side rib with an outlet in an outer surface in the at least one pressure side rib and an inlet that couples the at least one film cooling hole with the at least one cavity forming the internal cooling system;

wherein the outlet of the at least one film cooling hole is positioned in the chamfered surface of the at least one pressure side rib;

at least one film cooling hole positioned in the at least one suction side rib with an outlet in an outer surface in the at least one suction side rib and an inlet that couples the at least one film cooling hole with the at least one cavity forming the internal cooling system;

wherein the outlet of the at least one film cooling hole is positioned in the chamfered surface of the at least one suction side rib;

wherein the at least one pressure side rib and the at least one suction side rib are separated by a linear tip surface;

wherein the at least one pressure side rib and the at least one suction side rib are separated by a tip slot positioned at the trailing edge.

20. The turbine blade of claim 19, wherein the at least one pressure side rib has a height to width ratio of between 2:1 and 1:2 and wherein the at least one suction side rib has a height to width ratio of between 2:1 and 1:2.

* * * * *